US007281963B1

(12) United States Patent
Feng

(10) Patent No.: US 7,281,963 B1
(45) Date of Patent: Oct. 16, 2007

(54) ENERGY-CONSERVING SWIM FIN

(76) Inventor: Le-Jang Feng, No. 22-10, Lane 50, Tian Muu E. Rd., Taipei (TW)

( * ) Notice: Subject to any disclaimer, the term of this patent is extended or adjusted under 35 U.S.C. 154(b) by 0 days.

(21) Appl. No.: 11/642,462

(22) Filed: Dec. 19, 2006

(51) Int. Cl.
*A63B 31/08* (2006.01)

(52) U.S. Cl. ..... 441/64

(58) Field of Classification Search ..... 441/61, 441/62, 64; D21/806
See application file for complete search history.

(56) References Cited

U.S. PATENT DOCUMENTS 4,767,368 A * 8/1988 Ciccotelli ..... 441/64
4,944,703 A * 7/1990 Mosier ..... 441/62

* cited by examiner

*Primary Examiner*—Ed Swinehart

(74) *Attorney, Agent, or Firm*—Pro-Techtor Int'l Services

(57) ABSTRACT

An energy-conserving swim fin, in which a blade extends from a front portion of a foot pocket of a swim fin, and at least one spring is fitted at an appropriate position on the blade. The springs are structured such that support is provided when force is inwardly applied to two ends and extensibility when force is outwardly applied, and behavior of these two different force coefficients are brought about in a two-stroke alternate flapping motion during the course of manipulating the present invention, wherein, when kicking the water to push forward, the support provided by the springs enables the blade to form an angle against the water to achieve a propulsion effect, and during a restoring motion of the swim fin, extensibility provided by the springs enables the blade to form an angle that does not resist the water, thereby achieving effectiveness to conserve energy and rapidly return to original state, and thus assisting the swimmer in conserving physical strength and increasing staying power. Moreover, occurrence of foot cramp in the swimmer is reduced, especially when there is the need to speed up the alternate flapping motion to counteract adverse currents, when function of the present invention becomes apparent.

3 Claims, 4 Drawing Sheets

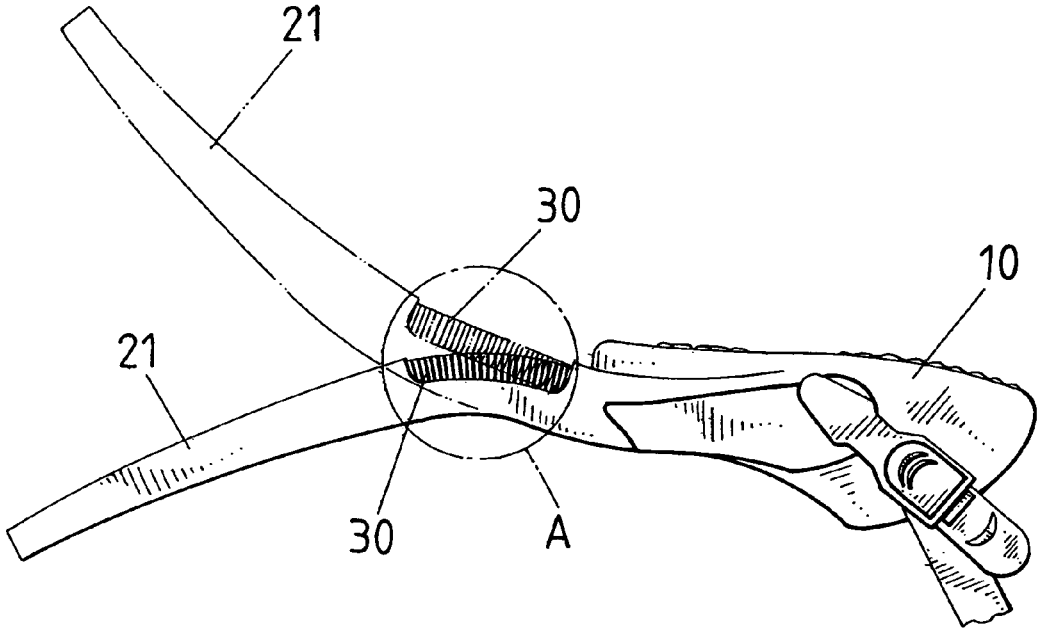
FIG.4
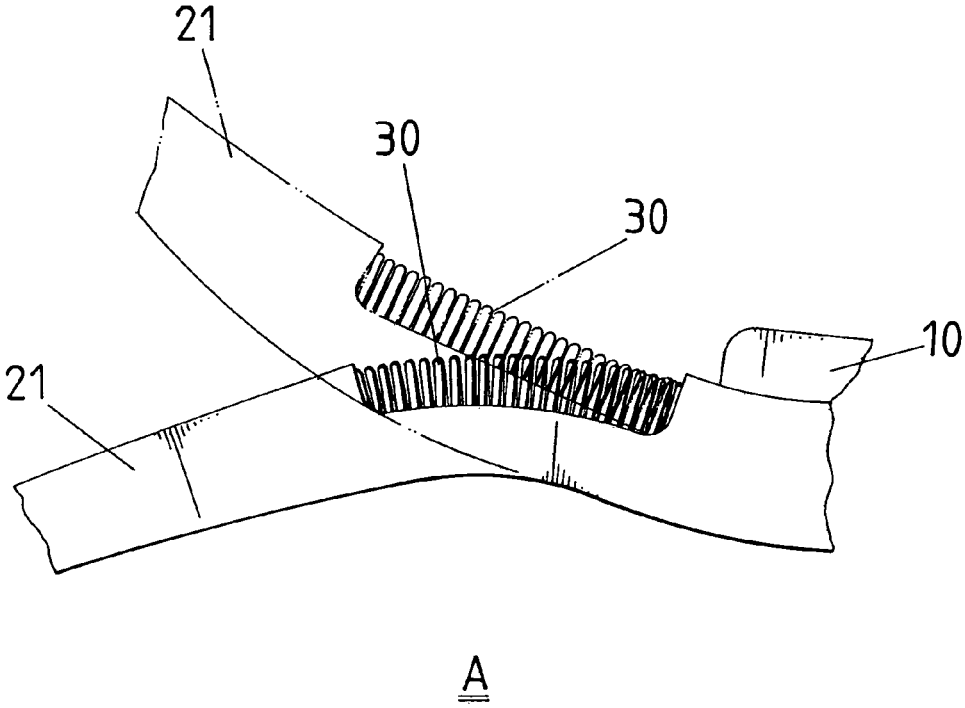
FIG.4~1

ENERGY-CONSERVING SWIM FIN

BACKGROUND OF THE INVENTION (a) Field of the Invention

The present invention relates to a swim fin, and more particularly to a swim fin having an energy-conserving function, wherein energy-conserving devices with springs are fitted to a swim fin, thereby enabling a swimmer to conserve energy when swimming, and thus increasing staying power to move forward and reducing probability of foot cramp.

(b) Description of the Prior Art

Referring to FIG. 1, which shows a conventional swim fin, wherein a blade 200 extends from a front portion of a foot pocket 100, and two sides of the blade 200 are respectively provided with a columnar body 201 to provide support for the swim fin. When a swimmer is in the water and moving his two feet up and down to force the swim fin into a two-stroke alternate flapping motion, the swimmer is able to kick the water to propel forward, and the support provided by the columnar bodies 201 enables the blade 200 to form an angle against the water to achieve a propulsion effect. Furthermore, when the flapping motion returns the swim fin back to its original state, the columnar bodies 201 still provide the same force coefficient for the blade 200 to form an angle against the water, thereby causing energy consumed in the restoring motion of the swim fin and kicking of the water to propel forward is the same. The angle against the water causes the restoring motion to slow down, and after a long period of use, because energy consumed by the alternate flapping motion of the swim fin is the same, thus, physical strength of the swimmer is easily overdrawn, which results in poor staying power, moreover, there is the danger of cramp easily occurring in the foot, especially when there is the need to speed up the alternate flapping motion to counteract adverse currents, which clearly reveals the need for improvement.

SUMMARY OF THE INVENTION

A primary object of present invention is to provide an energy-conserving swim fin, in which at least one spring is fitted at an appropriate position on a blade of a swim fin; the spring provides support when force is inwardly applied to two ends and extensibility when force is outwardly applied, and these two different force coefficients are brought about in a two-stroke alternate flapping motion during the course of manipulating the present invention, wherein, when kicking the water to push forward, the support provided by the springs enables the blade to form an angle against the water to achieve a propulsion effect, and during a restoring motion of the swim fin, the extensibility function provided by the springs enables the blade to form an angle that does not resist the water, thereby achieving effectiveness to conserve energy and rapidly return to original state, thus assisting the swimmer in conserving physical strength and increasing staying power, and, moreover, reducing occurrence of foot cramp in the swimmer.

To enable a further understanding of said objectives and the technological methods of the invention herein, brief description of the drawings is provided below followed by detailed description of the preferred embodiments.

BRIEF DESCRIPTION OF THE DRAWINGS

FIG. 4 shows a schematic view of horizontal motion according to the present invention.

FIG. 4~1 shows a partial enlarged view of FIG. 4 according to the present invention.

DETAILED DESCRIPTION OF THE PREFERRED EMBODIMENTS

Figure 2:
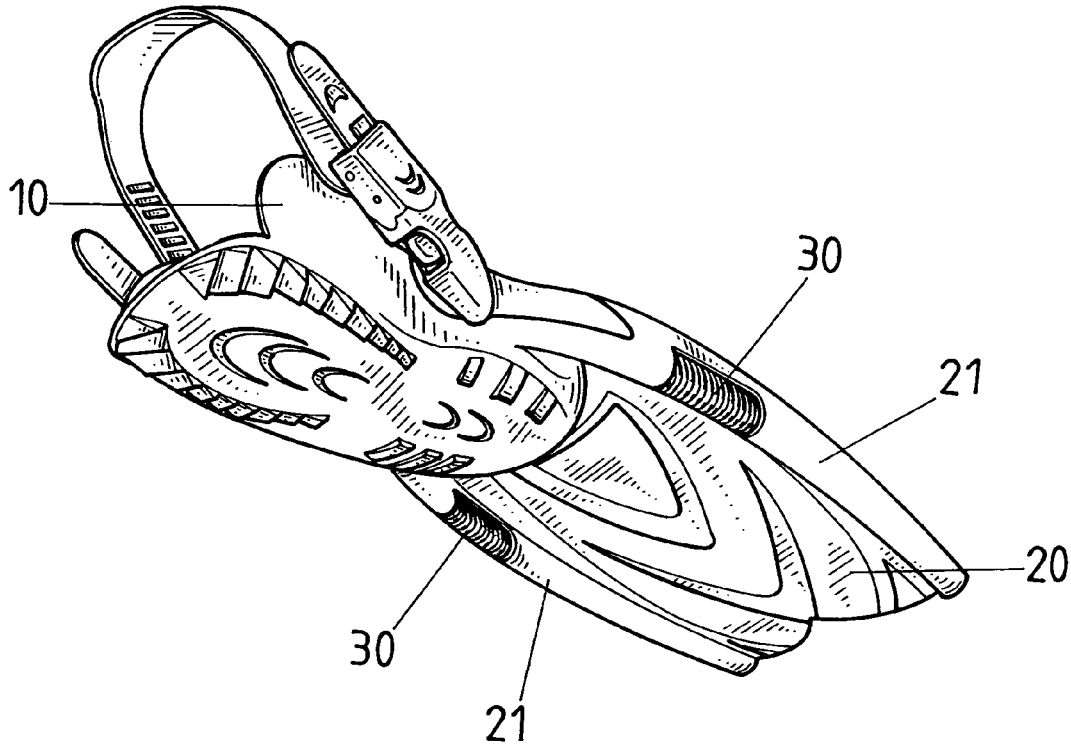
FIG. 2 shows a schematic view according to the present invention.
Figure 3:
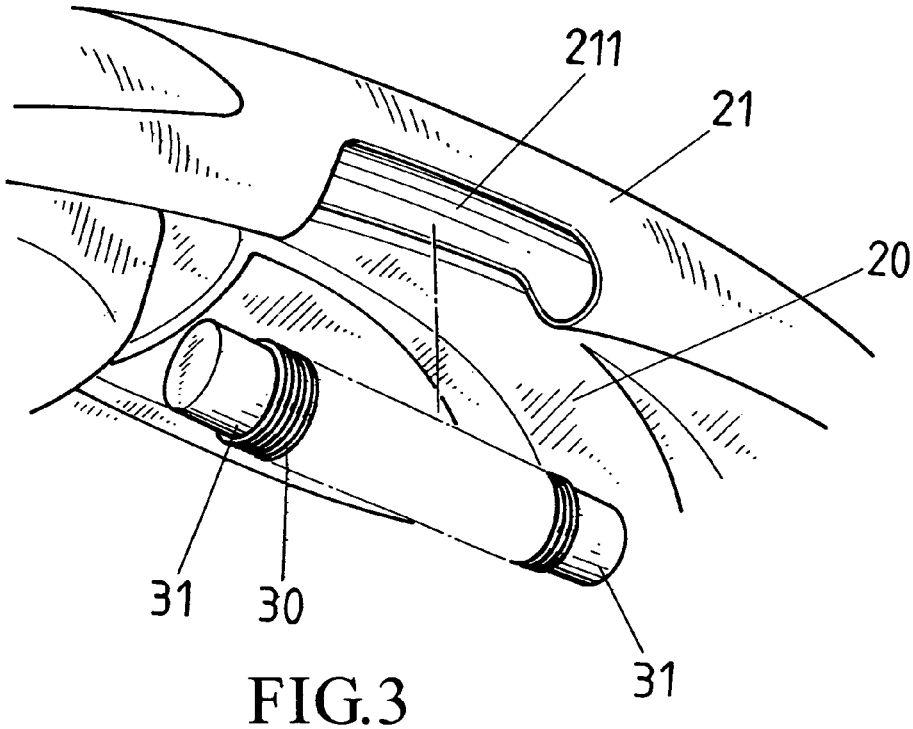
FIG. 3 shows a partial exploded view according to the present invention.

Referring to FIGS. 2 and 3, a blade 20 extends from a front portion of a foot pocket 10 of a swim fin of the present invention, and two sides of the blade 20 are respectively provided with a columnar body 21, wherein the swim fin of the present invention is characterized in that:

At least one spring 30 is fitted at an appropriate position on the blade 20, and the spring 30 is structured such that support is provided when force is inwardly applied to two ends and extensibility when force is outwardly applied. Behavior of these two different force coefficients are brought about in a two-stroke alternate flapping motion during the course of manipulating the present invention, wherein, when kicking the water to push forward, the support provided by the springs 30 enables the blade 20 to form an angle against the water to achieve a propulsion effect, and during a restoring motion of the swim fin, the extensibility function provided by the springs 30 enables the blade 20 to form an angle that does not resist the water, thereby achieving effectiveness to conserve energy and rapidly return to original state, and thus assisting the swimmer in conserving physical strength and increasing staying power. Moreover, occurrence of foot cramp in the swimmer is reduced, especially when there is the need to speed up the alternate flapping motion to counteract adverse currents, when function of the present invention becomes apparent.

Referring to FIG. 3, which shows a slot 211 gouged out of the columnar body 21 to enable embedding the spring 30 therein. The two ends of the spring 30 are respectively provided with an insertion piece 31, which enable tightly embedding and fixedly positioning the spring within the slot 211 therewith.

Figure 1:
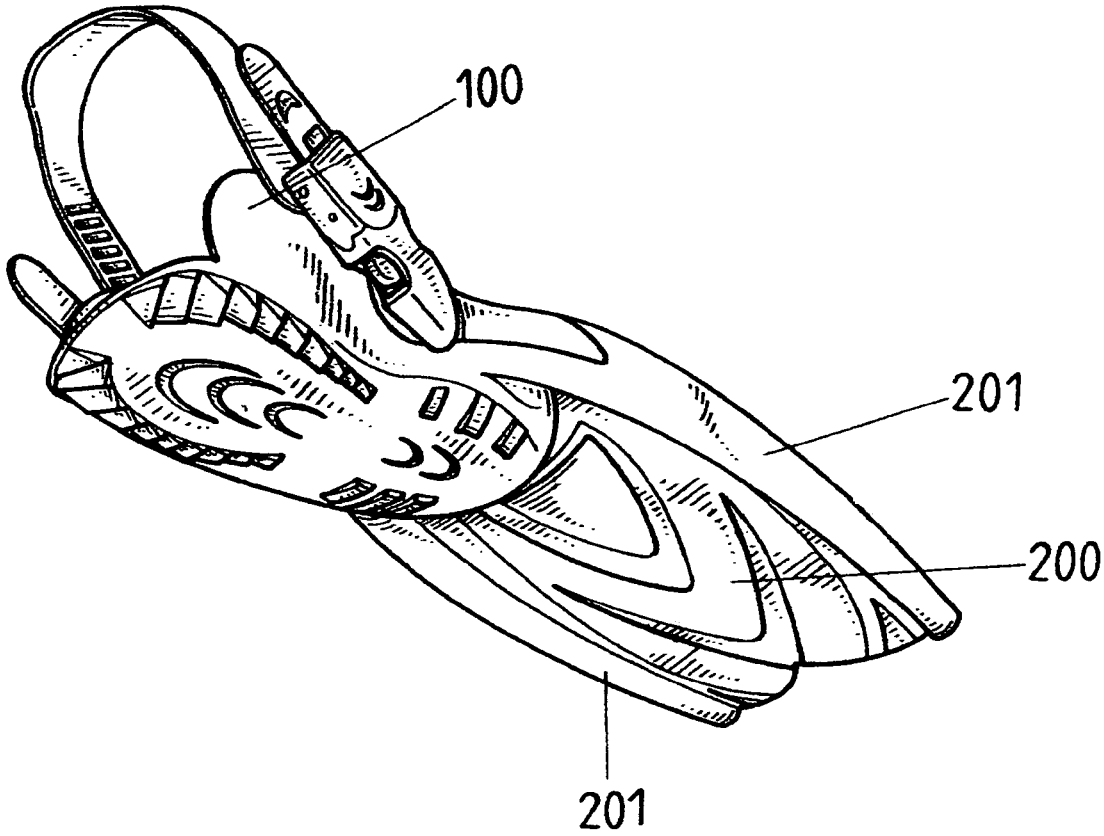
FIG. 1 Prior Art
FIG. 1 shows an elevational view of a swim fin of prior art.

Referring to FIGS. 4 and 4~1, which show the two-stroke alternate flapping motion of the swim fin, wherein when the foot of a swimmer presses downward and kicks the water to propel forward, because force is inwardly applied to the two ends of the spring 30, thus, the blade 20 is caused to rise upward forming an angle against the water to achieve a propulsion effect. During a restoring motion of the swim fin, the foot of the swimmer rises upward, while the blade 20 sways downward, and the springs 30 extending outward enable the blade 20 to form an angle that does not resist the water, thereby achieving effectiveness to conserve energy and rapidly return to original state, and thus assisting the swimmer in conserving physical strength and increasing staying power. Moreover, occurrence of foot cramp in the swimmer is reduced.

Figure 5:
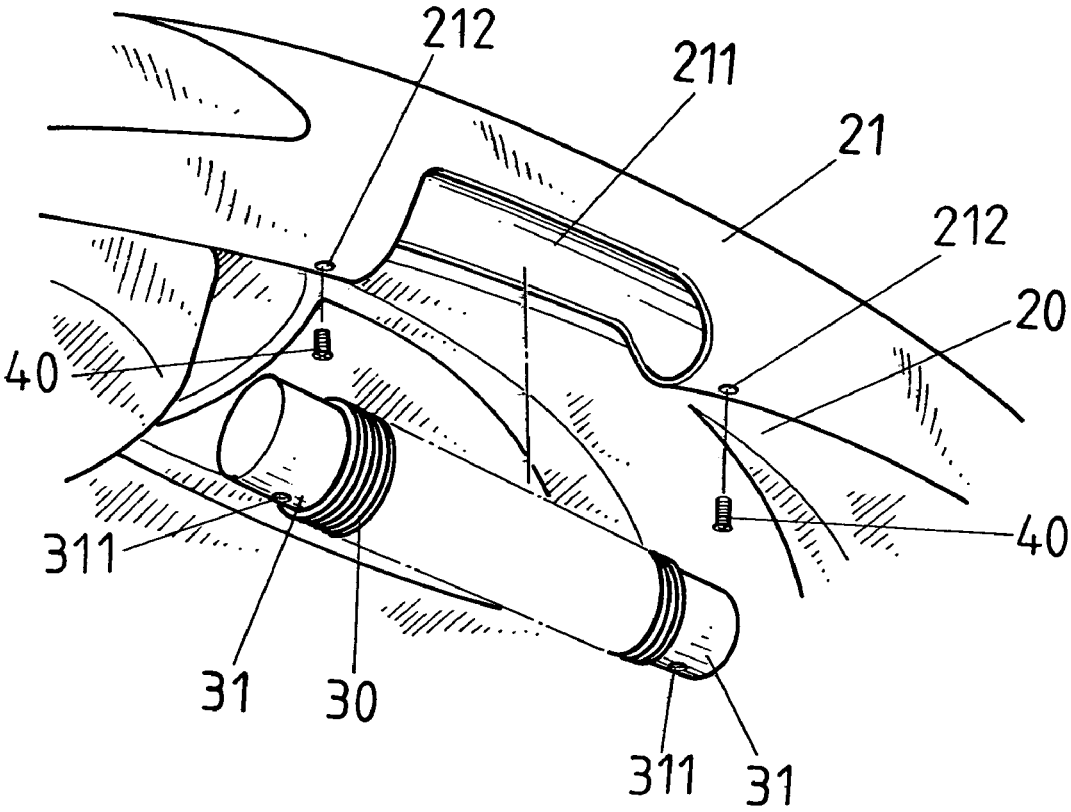
FIG. 5 shows a partial exploded view of an embodiment according to the present invention.

Referring to FIG. 5, screw holes 311 are respectively defined in the insertion pieces 31 of the two ends of the spring 30, and through holes 212 are respectively defined at two sides of the slot 211 of the columnar body 21 to enable two screws 40 to respectively penetrate the through holes 212 and fixedly screw into the screw holes 311 of the spring 30, thereby fixedly positioning the spring 30 within the slot 211.

As is apparent from the foregoing, the present invention uses the feature of the springs 30 to provide different force coefficients, and which are fitted to the blade 20 of the swim fin, thereby, when the swim fin is kicking the water to propel forward, support provided by the springs 30 enable the swim fin to form an angle against the water to achieve a propulsion effect. During a restoring motion of the swim fin, extensibility of the springs 30 enables the swim fin to form an angle that does not resist the water, thereby achieving effectiveness to conserve energy, which, apart from assisting the swimmer in increasing staying power to rapidly move forward, moreover, cramp will not easily occur in the foot of the swimmer when there is the need to speed up the alternate flapping motion to counteract adverse currents, thus, providing the present invention with superior safety performance.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An energy-conserving swim fin, comprising a blade extending from a front portion of a foot pocket of a swim fin, with at least one spring longitudinally fitted at an appropriate position on the blade;

wherein the spring provides two different force coefficients as support is provided when force is inwardly applied to two ends of the spring and extensibility is provided when force is outwardly applied;

whereby during the course of a two-stroke alternate flapping motion of the swim fin, the swim fin forms an angle against the water when kicking the water to push forward, thereby achieving a propulsion effect, and extensibility of the spring produced during a restoring motion of the swim fin enables the blade to form an angle that reduces resistence to the water, thereby achieving effectiveness to conserve energy and rapidly return to original state; and further wherein the blade at a location of each of the at least one spring is respectively provided with a columnar body, and the spring is respectively installed in slots defined at appropriate positions on the columnar body.

2. The energy-conserving swim fin according to claim 1, wherein two ends of each of the at least one spring are respectively provided with an insertion piece, and the insertion pieces of each spring being embedded within the respective slots to fix position of the spring therein.

3. The energy-conserving swim fin according to claim 2, wherein screw holes are respectively defined in the insertion pieces of the two ends of each of the at least one springs, and through holes are respectively defined at two sides of the slot of each of the columnar bodies to enable two screws to respectively penetrate the through holes of the columnar body and fixedly screw into the screw holes of the spring, thereby fixedly positioning the spring within the slot.

* * * * *